United States Patent [19]

Montez

[11] Patent Number: 4,828,690

[45] Date of Patent: May 9, 1989

[54] HAND TOOL FOR SIFTING DEBRIS FROM SAND AND SOIL

[76] Inventor: Obed Montez, 1050 C St., Salinas, Calif. 93905

[21] Appl. No.: 172,067

[22] Filed: Mar. 23, 1988

[51] Int. Cl.[4] ..... B07B 1/02

[52] U.S. Cl. ..... 209/418; 294/55; 56/400.11; 37/119

[58] Field of Search ..... 37/119, 120; 56/400.01, 56/400.04, 400.07, 400.11, 400.13; 209/374, 417, 418, 419, 614; 294/52, 53.5, 55

[56] References Cited

U.S. PATENT DOCUMENTS

| | | | |
|---|---|---|---|
| 879,291 | 2/1908 | Meinen | 294/52 X |
| 1,062,241 | 5/1913 | Kelly | 294/52 |
| 1,162,845 | 12/1915 | Armstrong | 294/53.5 |
| 1,531,156 | 10/1925 | Thissen | 172/13 |
| 1,782,497 | 11/1930 | Anderson | 37/119 |
| 3,394,483 | 7/1968 | Taglioli | 37/119 X |
| 3,608,217 | 9/1971 | Voisin | 37/119 X |
| 3,863,237 | 1/1975 | Doerr | 294/55 X |
| 3,979,146 | 9/1976 | Berg | 209/418 |
| 4,190,279 | 2/1980 | Sguazzin | 37/119 X |
| 4,311,332 | 1/1982 | Walker | 294/111 X |

FOREIGN PATENT DOCUMENTS

| | | | |
|---|---|---|---|
| 1918656 | 10/1970 | Fed. Rep. of Germany | 56/400.13 |
| 251813 | 8/1948 | Switzerland | 56/400.11 |

*Primary Examiner*—Johnny D. Cherry
*Assistant Examiner*—Gary C. Hoge
*Attorney, Agent, or Firm*—Thomas Schneck

[57] ABSTRACT

A hand tool having a tapered wedge head, an entrapment mesh supported by a carriage structure and cantilevered from the wedge head, and a handle adjustably coupled to the carriage structure. The tapered wedge head ramps materials, such as sand and soil, into the entrapment mesh. The entrapment mesh is fixed to the carriage structure such that the face and opposed sides of the carriage structure are open. The entrapment mesh is cantilevered from the wedge head to prevent contact of the mesh with the ground.

15 Claims, 3 Drawing Sheets

74
72
70
68
62
64
60
58
56
54
84
82
80
78
76

30
28
45
23
16
22
26

30
28
26
23
27
22
6a
6a

HAND TOOL FOR SIFTING DEBRIS FROM SAND AND SOIL

DESCRIPTION

1. Technical Field

This invention relates to tools used for maintenance of playgrounds, lawns, small gardens, landscaping and for performing a wide variety of granular material separation tasks.

2. Background Art

Groundkeepers, landscapers and individuals with small garden plots are regularly faced with removing debris from work areas and playgrounds. An example is the removal of broken glass from playgrounds bedded with sand. Therefore, a few tools have been introduced for cleaning soils. One such tool is a box with a screen attached to the bottom so that sand or soil may be shoveled into the box for separation of debris. After separation, the sand or soil must again be spread. Because of the labor and time involved in this process, groundkeepers have a tendency to neglect the grounds.

A tool in common use is the rake. The rake only gathers objects that do not pass through teeth, and even then the debris that is gathered has to be shoveled or picked up by hand, making the use of a rake unsatisfactory for separation of broken glass from sand. An extreme method of removing debris is to replace the old sand from playgrounds with new sand. This method, however, is very expensive. Another method which is implemented at golf course sand traps is use of a special hoe to cut weeds which then have to be raked with a leaf rake and picked up by hand. This multi-step method is labor intensive.

DISCLOSURE OF THE INVENTION

An object and advantage of the present invention is to provide a reliable, safe, and inexpensive tool for the removal of any type of debris from sand or loose soil. The invention is a rake-like implement with an adjustable handle for ease of operation by any person, regardless of height.

The hand tool includes a tapered wedge head, an entrapment mesh cantilevered from the wedge head to prevent contact of the mesh with the sand or soil, and a handle which is adjustably coupled to the entrapment mesh. The capability of exchanging different sizes of entrapment mesh on the tool increases the usefulness of the tool. For example, groundkeepers can now do spot cleanup of broken glass on playgrounds.

To remove debris from sand or soil, tapered teeth on the wedge head are pulled through the sand or loose soil as with any such rake-like instrument. This action results in accumulation of sand or soil and debris on the wedge head, and this accumulation is forced into the entrapment mesh. The sand or soil falls through the mesh, but the wanted or unwanted debris remains. The hand tool is then placed over a bag or trash receptacle, and twisted left or right to dispose of the debris.

An advantage of the present invention is that the hand tool requires a minimum of skill and training to master its use. This simplicity indicates that the tool is a relatively inexpensive device. Maintenance workers, landscapers and home owners will appreciate this tool since it so greatly eases the tasks in question, compared to the usual raking, shoveling, sifting and spreading procedures that are employed to accomplish the desired end.

Another advantage of the present invention is that the entrapment mesh can be easily exchanged with different sizes of mesh. Moreover, the hand tool provides the means for quickly cleaning playgrounds of hazardous debris. The tool is light-weight and small, so that any person can us it. The tool is non-mechanical, making it safe to use and almost maintenance free.

Figures 5, 6, 6A:
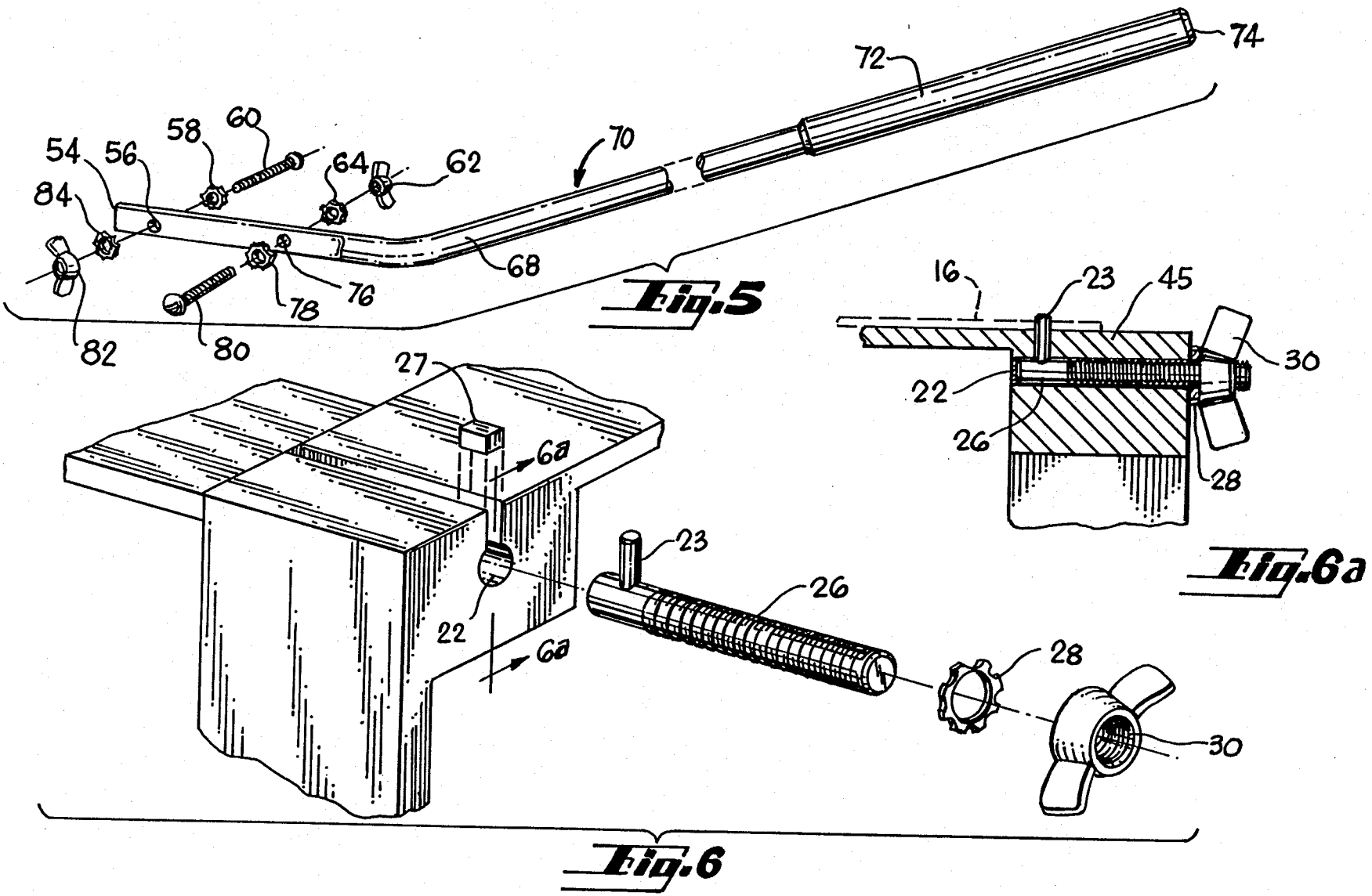
FIG. 5 is a side view of the handle assemble of FIG. 1.
FIG. 6 is an expanded view of the entrapment mesh fastener guide and attaching screw taken within line 6 of FIG. 3.

FIG. **6*a* is a sectional view of the fastener guide of FIG. 6 taken along lines 6*a*—6*a***.

BEST MODE FOR CARRYING OUT THE INVENTION

Figure 1:
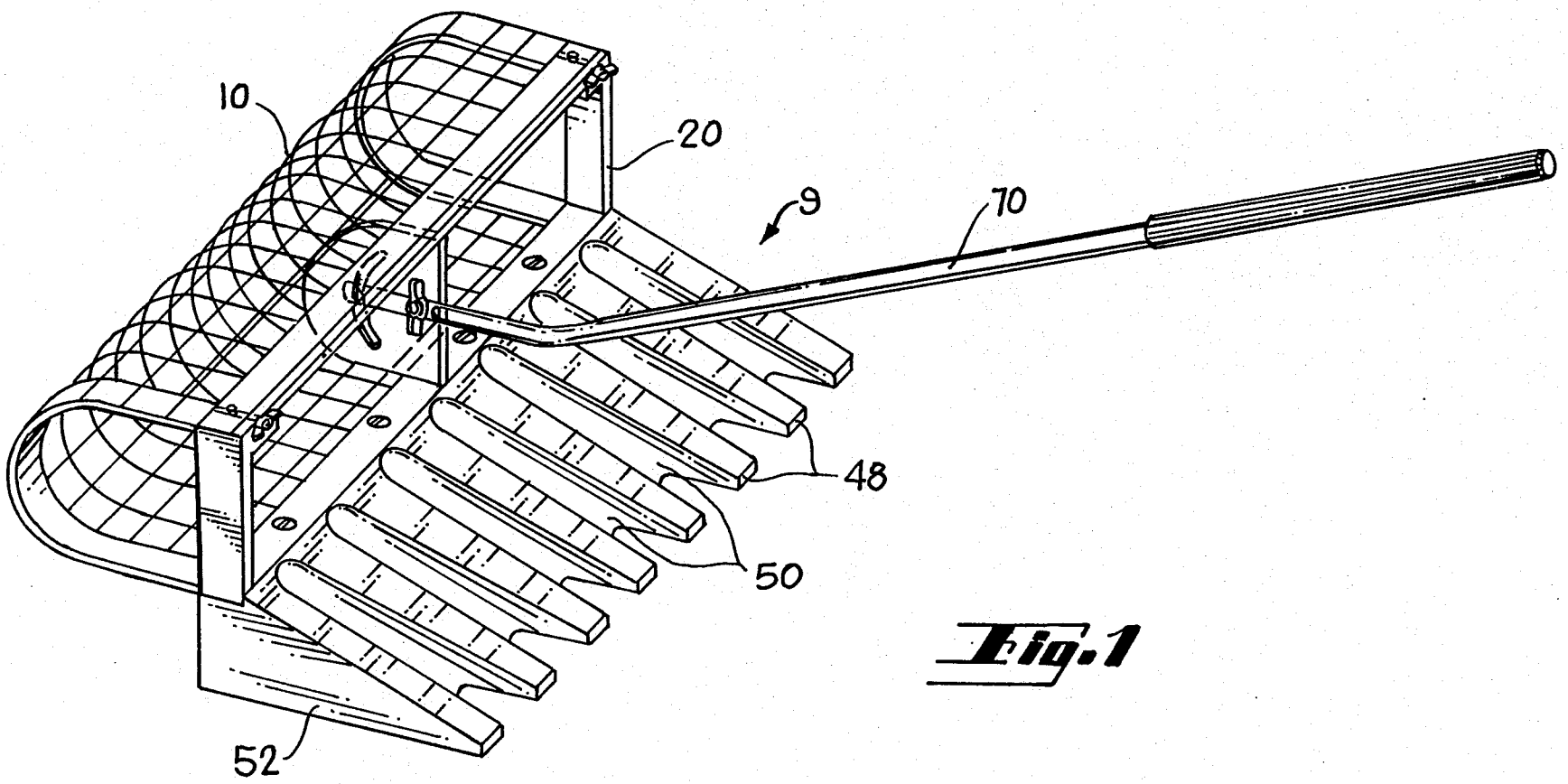
FIG. 1 is a perspective front elevational view of an assembled four-part tool according to the present invention.

With reference to FIG. 1, a four-piece hand tool 9 is shown as having an entrapment mesh 10, a carriage structure 20, a wedge head 52 and a handle 70. In operation, the wedge head 52 is rested upon soil or sand and dragged by application of force on the handle 70. The soil or sand is continuously moved up the wedge head and into the entrapment mesh 10, whereafter a sifting process takes place to remove glass, rocks and other debris.

Figures 2, 3, 4:
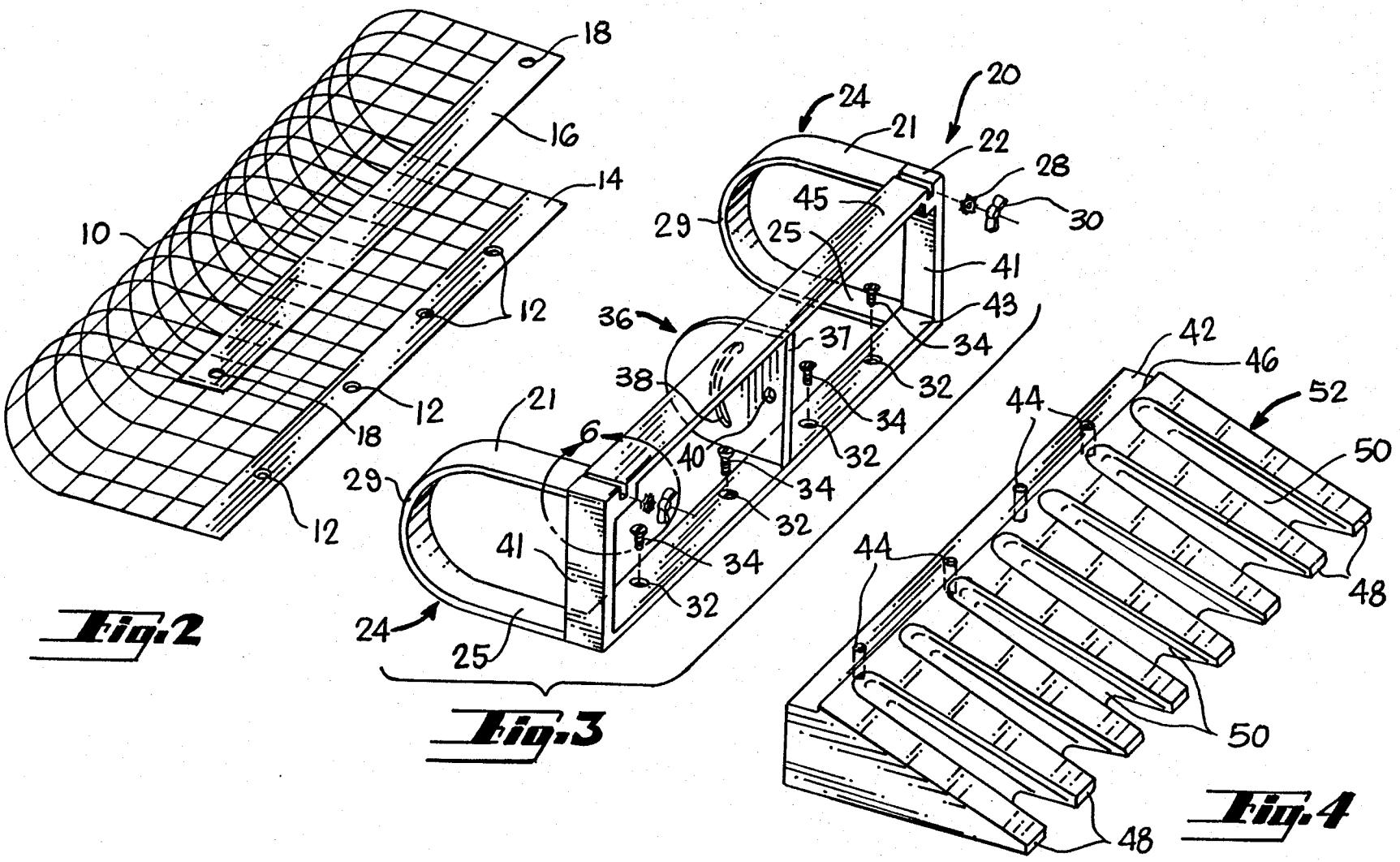
FIG. 2 is a perspective front view of the entrapment mesh assembly of FIG. 1.
FIG. 3 is a perspective front view of the carriage structure assembly of FIG. 1.
FIG. 4 is a perspective front view of the wedge head assembly of FIG. 1.

Referring now to FIGS. 1 and 2, the entrapment mesh 10 is preferably made of 0.25×0.25 inch, twenty-seven gauge galvanized wire fabric. The entrapment mesh 10 is about 16.25 inches wide and has a length from a bottom margin 14 to a top margin 16 of about 11.5 inches. The bottom margin 14, welded to entrapment mesh 10, is 0.625 inch wide by about 16.25 inches long, and is approximately 0.09 inch thick with four 9/64 inch holes 12 equally spaced and centered on the width of the bottom margin 14. The top margin 16 is identical to the bottom margin 14, except that the top margin has two 9/64 inch holes 18, one at each end.

FIG. 3 shows the preferred embodiment of carriage structure 20 as being rectangular in shape, with two U-shaped ribs 24 and one handle bracket 36. The U-shaped ribs 24 are each about 0.19 inch thick and are butt welded to the top and bottom of the carriage structure 20. The ribs 24 each comprise a pair of parallel linear portions 21 and 25 connected by a curved portion 29. The radius of the curved portion 29 is two inches, and the vertical distance between the linear portions 21 and 25 is approximately four inches.

The handle bracket 36 is fixed at the center of the carriage structure 20. The thickness of the handle bracket 36 is approximately 0.19 inch. The periphery of the handle bracket comprises a curved portion having a radius of about two inches, parallel straight edges one inch in length, and a face edge 37 of approximately four inches. The parallel straight edges of the handle bracket 36 are welded to the center of carriage structure 20.

The rectangular carriage structure 20 has an open face that is about four inches high by about 16 inches wide. Side members 41 and a bottom member 43 of carriage structure 20 are each about 0.19 inch thick and about 0.625 inch wide. A top member 45 of carriage structure 20 is about 0.19 inch thick by about one inch wide. Bottom member 43 of carriage structure 20 has four countersunk holes 32, spaced equally and centered to match holes 12 in bottom margin 14 shown in FIG. 2.

As will be explained more fully below, a handle is adjustably mounted to the handle bracket 36, a hole 40 acts as a pivot point in the mounting of the handle, while a slot 38 determines the range of adjustment. The hole 40 has a diameter of approximately 0.14 inch and the slot has a curvature of approximately 55 degrees.

Referring now to FIGS. 3, 6 and 6*a*, the top corners of carriage structure 20 each have a keyway 22. The thickness of the keyway is 0.625 inch. Each keyway is in line with the upper linear portion 21 of the associated rib 24. The keyway has a slit portion and a cylindrical lower portion.

The wedge head 52 is shown in FIG. 4 to include a fluted region comprising teeth 48 spaced apart by elongated, downwardly sloping, rounded grooves, or flutes 50. The teeth 48 taper downwardly, and rearward of the peak is a step region 42 which is recessed relative to the peak. In construction, the bottom margin 14 of the entrapment mesh 10 is captured against the step region 42 by the carriage structure 20 of FIG. 3. Internally threaded holes 44 in the step region are aligned with the holes 12 and 32 of the other members so as to receive machine screws 34.

As shown in FIG. 5, the handle 70 has a bend 68 near a handle end 54 which fastens to the above-described assemblies. The handle 70 is approximately sixty-six inches in length, with the distance from the bend 68 to the handle end 54 being slightly less than eight inches and the gripping end 74 being more than fifty-eight inches. The gripping end 74 has a fluted area 72 approximately twenty-seven inches in length.

An adjustment screw hole 56 and a pivot hole 76 at the handle end 54 are spaced apart from each other for alignment with the slot 38 and hole 40 of the handle bracket 36 of FIG. 3. A pair of screws 60 and 80 fasten the handle 70 to the handle bracket 36. Besides the screws 60 and 80, the fastening hardware includes star washers 58, 64, 78 and 84 and wing nuts 62 and 82. The screws are inserted from opposite directions and wing nuts 62 and 82 are tightened only after adjustment has been made within slot 38 to adapt to the height of the user and the type of work to be performed.

Again referring to FIGS. 3, 6 and 6*a*, the keyways 22 are used for securing entrapment mesh 10 illustrated in FIG. 2. The securement hardware includes a wingnut 30 and an L-screw 26. An L-screw prong 23 extends upwardly from the L-screw for projection above the keyway 22. L-screw prong 23 is 0.5 inch high by approximately 0.06 inch in circumference, and is connected at a right angle to the main part of the L-screw 26. The L-screw is inserted into the associated keyway 22 and retained in place by a retaining plug 27, a lock washer 28 and a wing nut 30. The retaining plug is a rubber rectangular cube 0.125 inch long, 0.375 inch high, and approximately 0.08 inch wide. Retaining plug 27 is inserted opposite to prong 23 in keyway 22. The holes 18 on the top margin 16 of the entrapment mesh 10 receive the L-screw prongs 23 to maintain the entrapment mesh in position.

In operation, the hand tool 9 of FIG. 1 is pulled within an area having an accumulation of debris embedded in soil or sand. Soil is forced up the flutes 50 of the wedge head 52 and enters the entrapment mesh 10. The entrapment mesh and carriage structure 20 provide an open face and open sides but prevent the escape of debris having dimensions that exceed the spacing defined by the strands of the entrapment mesh. In this manner, the soil is immediately returned to position but debris is collected. The entrapment mesh is easily emptied by rotation of the hand tool 9, so as to dump collected debris in a waste receptacle. The entrapment mesh is held above the ground and, therefore, does not mark the sifted soil. Moreover, the fastening hardware permits adjustment of the handle 70 to accommodate persons of various heights.

It is preferred that the hand tool be made of aluminum, but alternative materials such as plastics and alloys may be used. Additionally, fixed pins may be attached to the handle 70, with slanted slots made in the handle bracket to provide adjustment in height, rather than the adjustment structure described above. The tool could be made to vibrate by adding a mechanism that would shake the entrapment mesh, or the tool could be made to be pushed by fixing the handle in the opposite direction mentioned above. Moreover, the hand tool could be molded or welded in a uni-body construction.

I claim:

1. A hand tool for collecting debris from sand, soil and the like comprising, a wedge head having a ground-contacting surface and having first and second ends, said wedge head having a taper in height, from smaller to larger, in a direction from said first end towards said second end, an entrapment mesh rigidly cantilevered from said second end of said wedge head at a level above said ground-contacting surface, said entrapment mesh having spacings smaller in size than debris to be collected, said entrapment mesh forming a receptacle having an open face at the second end of the wedge head and having opposed sides, at least one of said opposed sides being open, and handle means coupled to said entrapment mesh for exerting a force on said wedge head to move said wedge head in a direction opposite said taper.

2. The hand tool of claim 1 further comprising a handle bracket coupled to said wedge head, said handle bracket having an adjustment slot generally extending in a direction perpendicular to said ground-contacting surface, said handle means being a longitudinal handle member releaseably fastened to said handle bracket at said adjustment slot for selectively repositioning said handle member.

3. The hand tool of claim 1 wherein said wedge has a plurality of parallel teeth extending in the direction of said taper.

4. The hand tool of claim 3 wherein portions of adjacent teeth are spaced apart by a flute, each flute being an elongated and rounded groove.

5. The hand tool of claim 4 wherein said plurality of teeth and flutes are downwardly sloped as determined by said taper, said teeth extending beyond said flutes at said first end of the wedge head.

6. A hand tool for separating debris from sand, soil and the like comprising, a wedge head having a first end and a second end and having a plurality of parallel teeth sloping from said second end to said first end, a carriage structure cantilevered from said second end of the wedge head in a direction away from said first end, said carriage structure having a face at said second end of the wedge head and having opposed sides, and a mesh having a first margin attached proximate to the junction of the wedge head and the carriage structure, said mesh extending over the carriage structure opposite said face and terminating at a second margin, said second margin having a length approximately equal to said face and having means for attaching said second margin to said carriage structure, thereby forming a receptacle that is open at said face and at least one of said opposed sides of the carriage structure.

7. The hand tool of claim 6 further comprising a plurality of L-screws, each having an elongated body and a prong extending perpendicularly from said body, said carriage structure having a plurality of longitudinal slots being open along one side thereof, each slot receiving an L-screw such that said prong projects through the open side of the slot, said means for attaching said second margin being fastened to said prongs.

8. The hand tool of claim 7 wherein said means for attaching said second margin is a plurality of holes projecting through said second margin, said holes aligned to receive said prongs.

9. The hand tool of claim 6 wherein each tooth of said wedge head is spaced apart from adjacent teeth by a flute.

10. The hand tool of claim 6 wherein said first margin of said mesh is captured between said wedge head and said carriage structure.

11. A hand tool for separating debris from sand, soil and the like comprising, a carriage structure having a face side, a pair of lateral sides and a back side opposite said face side, an entrapment mesh extending across said back side of carriage structure and having first and second margins attached at opposite ends of said face side of said carriage structure, said face side and said lateral sides remaining open, a tapered wedge head fixed to said carriage structure for ramping of materials into said face side of the carriage structure, said wedge head being tapered from larger to smaller in accord with the distance from the carriage structure, and handle means for exerting a force on said carriage structure for movement thereof.

12. The hand tool of claim 11 wherein said wedge head has a plurality of teeth extending in a direction parallel said taper and has a plurality of flutes spacing apart adjacent teeth.

13. The hand tool of claim 11 wherein said carriage structure is cantilevered from said wedge head.

14. The hand tool of claim 11 wherein said handle means is an elongated handle and said carriage structure includes a handle bracket, said handle bracket having an arcuate slot, one end of said elongated handle attached at said arcuate slot for selectively adjusting the angle of said elongated handle relative to said handle bracket.

15. The hand tool of claim 11 wherein said entrapment mesh defines spacings smaller than debris to be collected from said materials ramped into said face side of the carriage structure.

* * * * *